United States Patent [19]

Ahn

[11] 4,287,737

[45] Sep. 8, 1981

[54] LOCK USING NON-ROTATING PERFORATED PLATE KEY

[76] Inventor: Byung D. Ahn, 130-109 Sooyu-Dong, Dobong Ku, Seoul, Rep. of Korea

[21] Appl. No.: 77,820

[22] Filed: Sep. 21, 1979

[30] Foreign Application Priority Data

Sep. 23, 1978 [KR] Rep. of Korea ..... 2902/78
Sep. 23, 1978 [KR] Rep. of Korea ..... 2903/78

[51] Int. Cl.[3] ..... E05B 55/04; E05B 21/00
[52] U.S. Cl. ..... 70/467; 70/352
[58] Field of Search ..... 70/352, 351, 387, 350, 70/349, 134, 467–489

[56] References Cited

U.S. PATENT DOCUMENTS

| | | | |
|---|---|---|---|
| 2,692,495 | 10/1954 | Verdan | 70/351 |
| 3,681,953 | 8/1972 | Luttrall | 70/352 |
| 4,007,615 | 2/1977 | Nossum | 70/387 |
| 4,149,394 | 4/1979 | Sornes | 70/352 |

*Primary Examiner*—Robert L. Wolfe

*Attorney, Agent, or Firm*—Blanchard, Flynn, Thiel, Boutell & Tanis

[57] ABSTRACT

A lock mechanism operated by a slidable non-rotating perforated plate key having perforations disposed at random points thereon. The lock mechanism employs a slidable lock bolt controlled by a rotatable handle. A transversely slidable control rod is engageable within a groove formed in the lock bolt for holding the latter locked in its latched position. The control rod slidably extends through an opening formed in a transversely movable operating rod, the latter being spring-urged into a position of engagement with the control rod to normally maintain the control rod in its position of engagement within the groove. The plate key slidably coacts with the operating rod to displace same whereby it releases the control rod, whereupon the control rod is spring-urged downwardly through the opening in the operating rod so as to withdraw the control rod from the groove, thereby unlocking the lock bolt.

7 Claims, 6 Drawing Figures

LOCK USING NON-ROTATING PERFORATED PLATE KEY

FIELD OF THE INVENTION

This invention relates in general to a lock using a non-rotating perforated plate key. More particularly, it relates to a key which is formed as a plate which is selectively perforated, the operating perforations of which are determined on the plate as points at random on the imaginary X-Y axes plane, and the lock comprises a device having a control rod coacting between a locking member and an operating rod.

BACKGROUND OF THE INVENTION

The prior art is replete with various types of locks using a key. Such keys are of various types in accordance with the kinds of locks, and the one side or both sides of such a key may be formed with concave grooves or the like. In the key making process, substantial time and cost are required.

On the other hand, when such a key is used the key should be rotated and unlocked in the hole of a lock, and such an operating process is very inconvenient. Accordingly, when an improper key is inserted in the lock, the key may be bent and the lock may be broken. Also, the concave portion on the sides of the key is limited in the changeable degree, and the formation of various concave portions is impossible. Unlocking operations by a similar key is very easy, and a pilfer-unlocking operation is very convenient. Accordingly, prior art lock mechanisms using a conventional key as very complex.

Also, a lock in the prior art has a device limiting a returning operation of a key lever and is disposed in a cylinder of a lock. The cylinder is mounted by a spring and a stopped portion which checks the unlocking position. In addition, rotation is conducted by inserting the key into a hole of the lock. Accordingly, the hole and the structures in the lock are very complicated and the process of manufacture of the lock is time consuming and cost is high.

SUMMARY OF THE INVENTION

The present invention is provided to overcome the above disadvantages of the key and the lock in the prior art. Accordingly, it is an object of the present invention to provide a key formed as a non-rotating perforated plate, which is selectively perforated at randomly determined points on the imaginary X-Y axes plane in the key plate, and a lock mechanism which cooperates with the plate key.

A further object of the present invention is to provide a lock mechanism which can be activated with a non-rotating perforated plate key.

Another object of the present invention is to provide a key which has a simple and inexpensive process of manufacture, is capable of mass production, has a changeable arrangement and determination of operational points on the plate key, and prevents imitation of the key and pilfer-unlocking of the lock mechanism.

Briefly, the present invention accomplishes the foregoing by providing a lock bolt or latch member having a stop groove thereon for an actuating lever, a lock groove on the inner end thereof, and a pulling portion on the bottom thereof. A support means is resiliently supported on the lock bolt. A control rod is insertable into the lock groove, being pulled toward a released position by a resilient member. The lower end of the control rod protrudes through a sliding groove formed in an operating rod. A protruding portion of the control rod is stopped on the upper surface of the operating rod. A key formed as a non-rotating perforated plate activates the operating rod for releasing the control rod, which in turn releases the lock bolt.

BRIEF DESCRIPTION OF THE DRAWINGS

The novel features of the invention are set out with particularity in the appended claims, but the invention will be understood more fully and clearly from the following detailed description of the preferred embodiment as set forth in the accompanying drawings in which:

DETAILED DESCRIPTION

Figure 1:
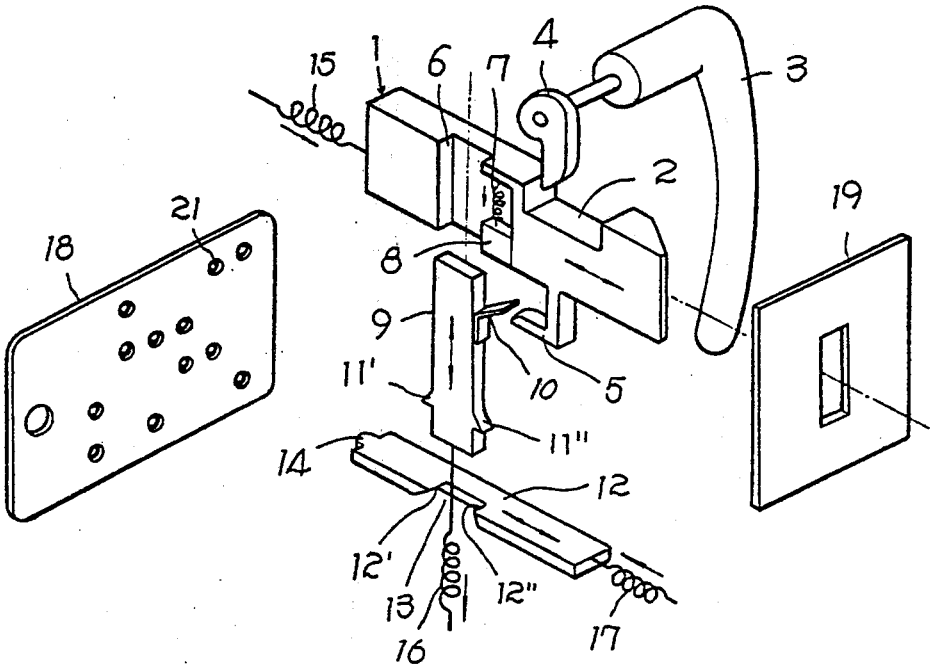
FIG. 1 is an exploded perspective view of a mechanism in accordance with and embodying the present invention.
Figure 2:
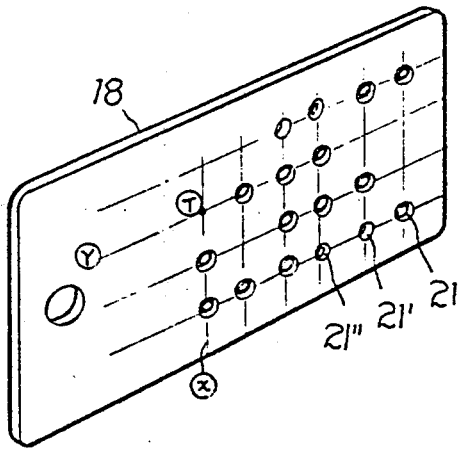
FIG. 2 is a perspective view of a key in accordance with and embodying the present invention.

Turning now to the drawing and referring first particularly to FIG. 1 and FIG. 2, a key plate 18, which is made of rigid material such as rigid plastics (i.e., polycarbonate) or metal, is formed with X-Y axes thereon and the position of the operating key is determined as the intersecting point T of the X-Y axes. The operating perforations 21,21' and 21" are formed so as to extend through the plate 18, the perforations being of the same size, and the key is thus formed as a nonrotating perforated plate.

Such a key 18 in accordance with this invention is very simple in the process of manufacture and cuts the cost of manufacturing. Also, mass production of the key in accordance with the invention can be accomplished.

On the other hand, the arrangement of the operating points on the plate key and the determination therefor are possible over an extensive range and the operating points are determined exactly. Accordingly, imitation of the key and pilfer-unlocking of the lock mechanism can be prevented or greatly minimized.

The lock mechanism in accordance with the present invention is formed with a stop groove 2 on the upper side of a slidable lock bolt 1; and an actuator lever 4, which is axially fixed on the end of rotary handle 3, is engaged with the stop groove 2. A guide or lock groove 6 is provided on the inner end of the lock bolt 1, which bolt also has an L-shaped pulling member 5 projecting downwardly therefrom. A support means 8, which is resiliently stopped by a spring 7, is slidably supported on bolt 1 adjacent one side surface of the groove 6.

A control rod 9, which is inserted into the groove 6, is provided with a resilient pulling portion 10 for engaging the elbow-shaped pulling portion 5. Rod 9 also has opposite sidewardly protruding cam portions 11' and 11".

An operating rod 12 is movably positioned below the bolt 1 and has a rounded checking protrusion 14 on the inner end thereof. The operating rod 12 also has formed therein a groove 13 through which projects the lower end of the control rod 9.

Springs are designated by numbers 15, 16 and 17, and number 19 is a stop plate for the lock bolt, and number 20 is a body or housing for the lock mechanism.

The lock bolt 1 is linearly reciprocally movable in its longitudinal or lengthwise direction, as indicated by the arrow in FIG. 1, and in fact is urged (rightwardly in FIG. 1) by spring 15 toward the stop plate 19 so as to normally be in a latching, hence a locking, position. The operating rod 12 is also linearly reciprocal, as indicated by the arrow in FIG. 1, in its lengthwise direction so that operating rod 12 moves substantially parallel with the movement of bolt 1. Spring 17, however, normally urges operating rod 12 in the opposite direction, that is leftwardly in FIG. 1. The control rod 9 is linearly reciprocal perpendicularly to rod 12 and bolt 1 for controlling the position of the latter.

Figure 3:
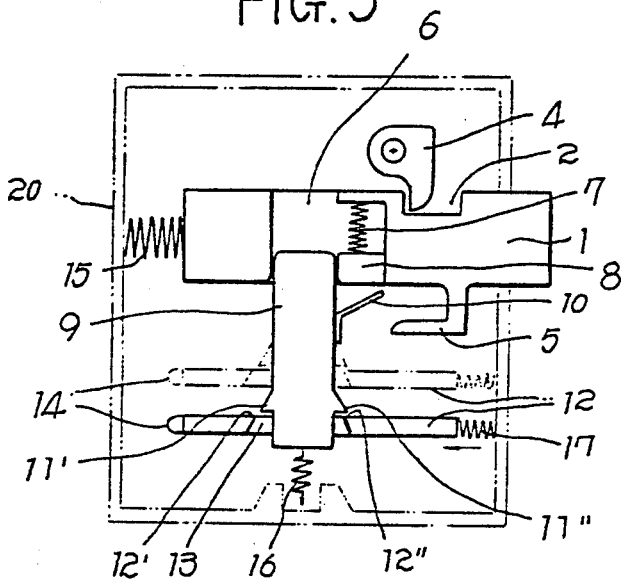
FIG. 3 shows the locked state of a mechanism in accordance with the present invention.

The use or operation of the present invention may be described as follows:

FIG. 3 shows the locked state of the lock mechanism wherein the control rod 9 is in its raised latching position and is snugly disposed between the groove 6 of the lock bolt 1 and the sliding groove 13 of the operating rod 12. Operating rod 12 is resiliently urged leftwardly so that the protruding portion 11'' is engaged with the upper surface of rod 12 adjacent the right side of the sliding groove 13. Accordingly, the lock bolt 1 is completely locked.

Next, when the key 18 is slidably inserted into the keyhole (not shown) of the lock, the key engages protrusion 14 and cams rod 12 rightwardly so that protrusion 11' engages the upper surface 12' of rod 12 adjacent the left side of groove 13. The checking protrusion 14 on the one end of the operating rod 12 is then selectively moved loosely and slidably along the key to check the operating perforations 21, 21' and 21'' on the plate key, which perforations define the unlocking position.

Figure 4:
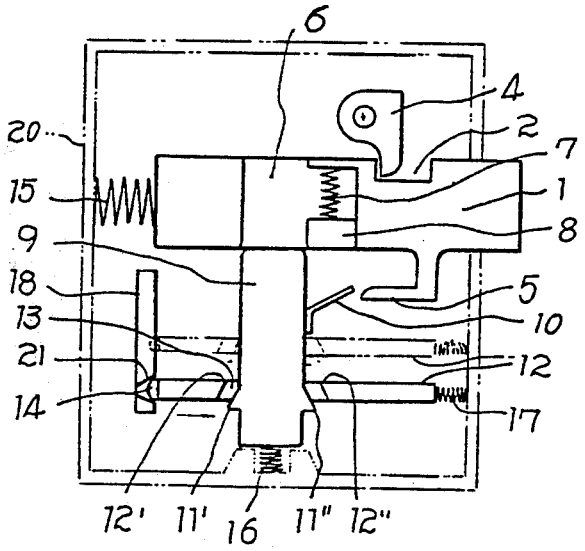
FIG. 4 shows the unlocked state of the mechanism in accordance with and embodying the present invention, with a key inserted in the keyhole.

After checking, the protrusion 14 is inserted into the appropriate operating perforation 21, 21' or 21'', and at the same time the operating rod 12 is pressed in the rightward direction by spring 17. The protruding portion 11', which was stopped on the left upper end surface 12' adjacent the sliding groove 13 on the operating rod 12, is removed, and after which the control rod 9 is moved downwardly by the spring 16 into the FIG. 4 position, whereupon the upper end of the control rod 9 is removed from the groove 6 on the lock bolt 1.

Accordingly, opening (leftward) movement of the lock bolt 1 by rotation of the handle 3 is now possible.

For the above unlocking operation, when the operating perforations 21, 21' and 21'' of the key plate 18 are not checked by the checking protrude 14, or if the perforation 21 is undersized and not snugly suitable for receiving the protrusion, then the key plate 18 is maintained pressed in the right direction so that the left protrude 11' is stopped on the left upper end 12' adjacent the sliding groove 13.

Figure 5:
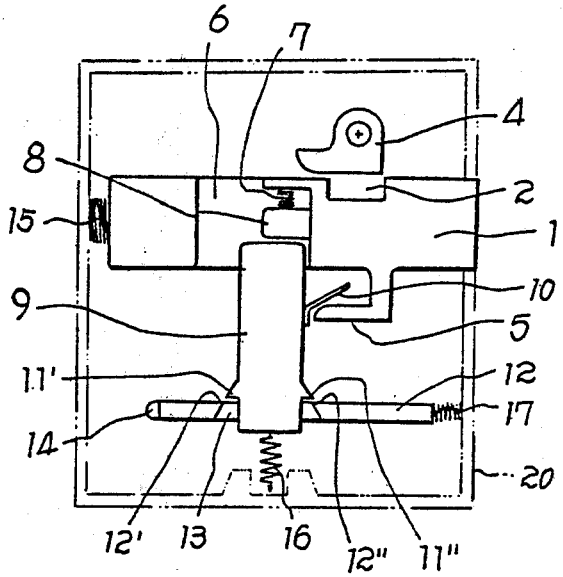
FIG. 5 and FIG. 6 show the unlocking process of a mechanism in accordance with and embodying the present invention.
Figure 6:
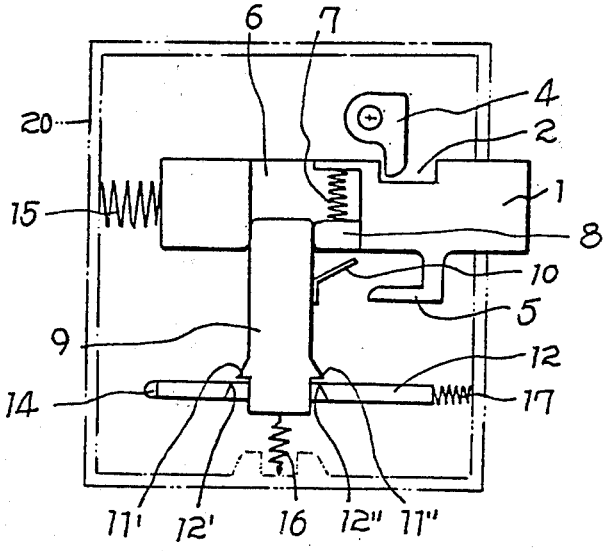

Accordingly, the protrusion 11' is not improperly removed from the upper end surface 12' of the sliding groove 13. The present invention can be provided with a variety of lock devices when the operating rod 12 in accordance with this invention is disposed and the operating conditions of the rod 12 utilized at different levels; stopping and removing conditions on the protrusions 11' and 11'' are controlled. And when the lock mechanism in accordance with the present invention is unlocked, the key 18 is taken out from the keyhole of the lock, and the handle 3 is rotated. Rotating the lever 4, which is axially fixed on the handle 3, moves the lock bolt 1 leftwardly into the position shown in FIG. 5. At the same time, the pulling member 5 which is formed on the bottom of the lock bolt 1 cams the resilient portion 10 upwardly so that the control rod 9 is pulled upwardly into groove 6.

In addition, when the protrusions 11' and 11'' formed on the control rod 9 are positioned above the upper surface of the operating rod 12, the rod 12 is pressed leftwardly by spring 17 so that the protrusion 11'' is stopped on the upper end surface 12'' of the sliding groove 13 on the operating rod 12. At the same time, the support means 8, which is resiliently stopped with the spring 7 on the side of the groove 6, is pushed upwardly by the upper end of the control rod 9, and the lock bolt 1 is in its retracted or leftward position.

When the handle 3 is returned to its original position, the lock bolt 1 is pressed by spring 15 in the rightward direction so that the lock again assumes the FIG. 1 position. The upper end of the control rod 9 is removed from the contact with the bottom of support means 8, and is inserted into the groove 6 of the lock bolt 1 and locked in that position.

In the operation of the present invention, plural vertically spaced operating rods 12 may be provided for controlling moving of the control rod 9 (see the dotted lines of FIG. 3 and FIG. 4), and plural checking points on the key 18 are formed. With this arrangement, all of rods 12 must be in their central unlocking position, due to registry with a proper perforation on the key, in order to release the control rod 9. Accordingly, pilfer-unlocking can be prevented more effectively. The checking protrusion 14 formed on the one end of the operating rod 12 can have its shape or size changed, i.e., the diameter and length, for more effective use.

The key in accordance with the present invention need not be perforated, but can be operated by forming an operating groove. The above key also can be operated by forming an irregulated surface on the X-Y axes of the plate key.

As above stated, by inserting the plate key into the keyhole of the lock in accordance with the present invention, the unlocking operation is possible. Without the operation of rotating the key as in the prior art, use or operation of the present invention is very simple and can be more effective for preventing the breakage of the key and other troubles with the lock mechanism.

When unlocked, the key is removed from the keyhole of the lock mechanism and the locking operation can be exactly finished. The structure of the lock mechanism is very simple and precise, and mass production for a variety of locks can be conducted.

I claim:

1. In a locking arrangement including a lock mechanism and a slidable non-rotating perforated key plate for operating the lock mechanism, said locking mechanism comprising:

a slidable lock bolt having a first groove therein adapted to receive a part of a swingable handle for controlling slidable displacement of the lock bolt along a first direction from a latching position into an unlatched position, said latch bolt also having a second groove formed therein and extending along a second direction which is transverse with respect to said first direction;

a support member slidably supported within said second groove adjacent one side edge thereof and being slidably displaceable longitudinally therealong, and a spring coacting between the lock bolt and said support member for urging the latter into a position adjacent one end of said second groove;

an elongated control rod slidably supported for movement along said second direction between a first position wherein one end of the control rod is engaged within the second groove and a second position wherein the one end of the control rod is withdrawn from the second groove and is thus disengaged from the lock bolt, said control rod having a projecting cam portion associated therewith;

said lock bolt having an L-shaped cam portion projecting sidewardly therefrom and being engageable with the projecting cam portion associated with the control rod when the lock bolt is moved toward its unlatched position for movably displacing the control rod away from said second position so that the end of the control rod is moved into said second groove, the end of said control rod engaging and causing displacement of said support member against the urging of its spring when the control rod moves into the second groove and the lock bolt is displaced away from its latching position, said lock bolt when returned to its latched position causing said end of said control rod to be positioned adjacent the other side edge of said second groove so that the spring urges the support member into a position wherein it is sidewardly disposed between the control rod and said one side edge of the second groove for locking the lock bolt in its latching position; and an operating rod having an opening therein for slidably receiving the other end of said control rod for controlling the movement of the control rod from its first position toward its second position, said operating rod being slidably displaceable along a third direction which extends transversely relative to said first direction, said operating rod being normally urged into a holding position wherein the operating rod engages the control rod and maintains it in said first position, said operating rod having a protrusion on one end thereof which, when engaged with an appropriate recess formed on the key plate, permits the operating rod to be moved into a release position wherein it disengages the control rod so that the latter is automatically moved into said second position so as to unlock the lock bolt.

2. A key-controlled lock, comprising:

a lock bolt slidably movable in a first direction between latched and unlatched positions, said lock bolt having a portion thereof engageable with an actuating lever for causing slidable displacement of the lock bolt into its unlatched position, said lock bolt also having a first slide groove formed thereon and extending along a second direction which is transverse relative to said first direction;

a control member slidably movable between locking and unlocked positions along said second direction, said control member when in said locking position being slidably engaged within said first groove for maintaining said lock bolt in said latched position, said control member being normally urged toward said unlocked position wherein said control member is disengaged from said groove;

an operating member slidably supported for movement in a third direction which extends transversely relative to said second direction, said operating member having a second groove therein for accommodating said control member, said operating member being normally urged into a first position wherein it engages said control member for maintaining the latter in said locked position; and a platelike, non-rotating key being slidably engageable with said operating member for slidably displacing same into a second position wherein the operating member releases the control member so that the latter is urged into its non-locking position wherein the control member is thus slidably removed from said first groove.

3. An arrangement according to claim 2, wherein said lock bolt has a spring-urged support member slidably supported thereon adjacent one edge of said first groove for slidable displacement in a direction parallel with said first groove, said control member being engageable with and causing linear displacement of said support member against the urging of said spring when the control member is being moved toward said locking position, and said control member being sidewardly confined between said first groove and said support member when in said locking position.

4. An arrangement according to claim 3, wherein said support member is slidably supported within said first groove along one side edge thereof so that said control member can project into said first groove and cause linear displacement of said support member even when said lock bolt is not in said latching position, said support member being spring-urged into a position wherein it is sidewardly displaced between the one edge of said first groove and an adjacent side edge of said control member when the lock bolt is moved into said latching position for locking said lock bolt in said latching position due to said control member being in its locking position.

5. An arrangement according to any one of claims 2–4, including means coacting between said lock bolt and said control member for slidably moving the latter into the first groove in response to the lock bolt being slidably displaced from its latching position toward its unlatched position, said coacting means including a projecting portion associated with the control member which is cammingly engaged by a camming portion associated with the lock bolt so that the camming portion engages the projecting portion and pushes the control member away from its unlocked position into the first groove in response to slidable displacement of the lock bolt away from its latching position.

6. An arrangement according to claim 2, wherein the control member has a protruding portion which is engaged with said operating member when the latter is in said first position for maintaining said control member in a position wherein it projects into said first groove, said operating member being spring-urged into said first position, said control member also having a second protruding portion which is adapted to engage said operating member for maintaining the control member in engagement with the lock bolt when the operating member is in a third position which is located on the opposite side of said second position from said first position, said key when slidably engaged with said operating member causing the latter to be cammed away from said first position into said third position, and said key having a depression thereon engageable with a protrusion on said operating member for permitting the latter to be spring-urged from said third position into said second position so that the operating member releases the control member and the latter is moved into its unlocked position wherein it is disengaged from the lock bolt.

7. An arrangement according to claim 2 or claim 6, wherein a plurality of independently movable operating members slidably coact with said control member for controlling the movement thereof, said key controlling all of said operating members and permitting release of the control member only when all of the operating members have been moved into their respective second positions.

* * * * *